US010836180B2

(12) United States Patent
Takahashi et al.

(10) Patent No.: US 10,836,180 B2
(45) Date of Patent: Nov. 17, 2020

(54) PRINTING APPARATUS AND INK LEAKAGE DETECTION METHOD IN PRINTING APPARATUS

(71) Applicant: CANON KABUSHIKI KAISHA, Tokyo (JP)

(72) Inventors: Atsushi Takahashi, Tama (JP); Yoshinori Nakagawa, Kawasaki (JP); Takatoshi Nakano, Yokohama (JP); Takuya Fukasawa, Yokohama (JP); Tsuyoshi Saeki, Kawasaki (JP); Toshiaki Tokisawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/575,057

(22) Filed: Sep. 18, 2019

(65) Prior Publication Data

US 2020/0108624 A1 Apr. 9, 2020

(30) Foreign Application Priority Data

Oct. 5, 2018 (JP) ..... 2018-189671

(51) Int. Cl.
*B41J 2/175* (2006.01)

(52) U.S. Cl.
CPC ..... *B41J 2/17566* (2013.01)

(58) Field of Classification Search
CPC ..... B41J 2/175; B41J 29/393; B41J 2/17566
See application file for complete search history.

(56) References Cited

U.S. PATENT DOCUMENTS

| | | | | |
|---|---|---|---|---|
| 9,272,522 | B1 | 3/2016 | Kosaka et al. | B41J 2/17566 |
| 9,597,888 | B2 | 3/2017 | Takahashi et al. | B41J 2/17566 |
| 9,682,564 | B2 | 6/2017 | Saeki et al. | B41J 2/17513 |
| 10,357,977 | B2 | 7/2019 | Mukoyama et al. | B41J 2/17596 |
| 10,427,412 | B2 | 10/2019 | Okude et al. | B41J 2/17523 |
| 2011/0187772 | A1* | 8/2011 | Tomoguchi | B41J 2/17546 347/7 |

(Continued)

FOREIGN PATENT DOCUMENTS

| | | |
|---|---|---|
| JP | 2011-042120 | 3/2011 |
| JP | 2017-094735 | 6/2017 |

OTHER PUBLICATIONS

U.S. Appl. No. 16/573,967, filed Sep. 17, 2019.

*Primary Examiner* — Lamson D Nguyen
(74) *Attorney, Agent, or Firm* — Venable LLP

(57) ABSTRACT

A printing apparatus includes: a printing unit configured to eject ink supplied from a storage unit to perform a printing operation; a detection unit configured to detect ink stored in the storage unit; and an acquisition unit configured to acquire a consumption amount of ink consumed in the printing operation from the storage unit. The printing apparatus includes: a calculation unit configured to calculate a decrease amount that is a difference between the ink amount in the storage unit detected by the detection unit prior to the printing operation and the ink amount in the storage unit detected by the detection unit after the printing operation; and a determination unit configured to determine an ink leakage in a case where a difference between the decrease amount calculated by the calculation unit and the consumption amount acquired by the acquisition unit is larger than a threshold value.

15 Claims, 15 Drawing Sheets

(56) References Cited

U.S. PATENT DOCUMENTS

| | | | | |
|---|---|---|---|---|
| 2014/0063152 | A1* | 3/2014 | Ito | B41J 2/17596 347/86 |
| 2016/0059571 | A1* | 3/2016 | Kobayashi | B41J 2/17513 347/7 |
| 2017/0144449 | A1 | 5/2017 | Guelck | B41J 2/17566 |
| 2019/0009562 | A1 | 1/2019 | Abe et al. | B41J 2/175 |
| 2019/0009563 | A1 | 1/2019 | Tokisawa et al. | B41J 2/175 |
| 2019/0283443 | A1 | 9/2019 | Mukoyama et al. | B41J 2/16517 |
| 2019/0299648 | A1 | 10/2019 | Tokisawa et al. | B41J 2/17596 |
| 2019/0299649 | A1 | 10/2019 | Shimoyama et al. | B41J 29/13 |
| 2019/0299650 | A1 | 10/2019 | Saeki et al. | B41J 2/17566 |

* cited by examiner

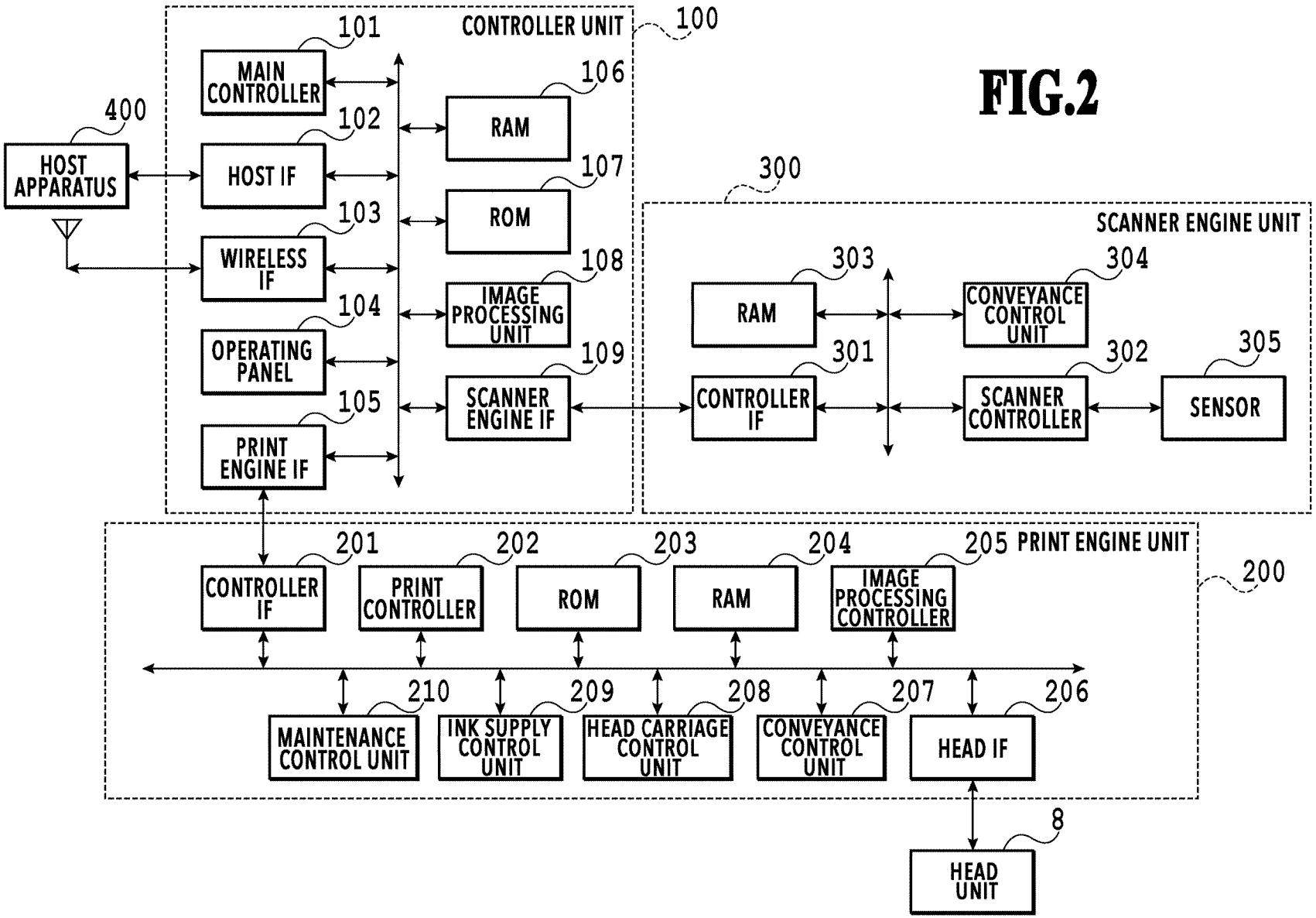
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
RAM
303
CONTROLLER IF
301
CONVEYANCE CONTROL UNIT
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
MAINTENANCE CONTROL UNIT
210
INK SUPPLY CONTROL UNIT
209
HEAD CARRIAGE CONTROL UNIT
208
CONVEYANCE CONTROL UNIT
207
HEAD IF
206
HEAD UNIT
8

| SUCTION RECOVERY TYPE | INK CONSUMPTION AMOUNT |
|---|---|
| FIRST SUCTION RECOVERY | 1g |
| SECOND SUCTION RECOVERY | 4g |

FIG.12

| AMOUNT OF INK IN THE SUB TANK | PRESSURIZATION TIME T1 |
|---|---|
| 80g OR MORE AND LOWER THAN 84g | 50 seconds |
| 84g OR MORE | 60 seconds |

FIG.15

PRINTING APPARATUS AND INK LEAKAGE DETECTION METHOD IN PRINTING APPARATUS

BACKGROUND OF THE INVENTION

Field of the Invention

The present invention relates to a printing apparatus that ejects ink to print an image and an ink leakage detection method in the printing apparatus.

Description of the Related Art

Japanese Patent Laid-Open No. 2011-42120 discloses an ink leakage detection method of an ink jet printing apparatus including a liquid surface detector to detect the ink amount in an ink tank for storing ink ejected through a printing head. This method detects an ink leakage by performing a standby processing to adjust, when the printing operation is completed, the amount of ink in the ink tank to a predetermined amount and a detection processing to detect, when the next printing operation is started, whether the predetermined ink amount is maintained in the ink tank or not.

However, in the case of the ink leakage detection method disclosed in Japanese Patent Laid-Open No. 2011-42120, only the ink leakage is detected that occurs in a period from the completion of the printing operation to the start of the next printing operation. Thus, this ink leakage detection method cannot detect an ink leakage caused during an ink consumption operation such as a printing operation.

SUMMARY OF THE INVENTION

It is an objective of the present invention to provide a printing apparatus and an ink leakage detection method by which an ink leakage caused during an ink consumption operation can be detected.

The present invention provides a printing apparatus, comprising: a storage unit configured to store ink; a printing unit configured to eject ink supplied from the storage unit to perform a printing operation on a printing medium; a detection unit configured to detect a liquid surface of the ink stored in the storage unit; an acquisition unit configured to acquire a consumption amount of ink consumed in the printing operation from the storage unit; a calculation unit configured to calculate a decrease amount that is a difference between the ink amount in the storage unit detected by the detection unit prior to the printing operation and the ink amount in the storage unit detected by the detection unit after the printing operation; and a determination unit configured to determine an ink leakage in a case where a difference between the decrease amount calculated by the calculation unit and the consumption amount acquired by the acquisition unit is larger than a threshold value.

The present invention provides a printing apparatus, comprising: a printing unit including an ejection port for ejecting ink; a storage unit configured to store ink supplied to the ejection port; an ink flow path for connecting the storage unit and the ejection port; a pressurization unit for supplying pressurized ink from the storage unit to the printing unit; a negative pressure generation unit that is provided at the downstream of the printing unit and that generates a negative pressure in the ink flow path; a differential pressure valve that is provided in the ink flow path and that is opened when the downstream-side pressure of the ink flow path is caused by the negative pressure generation unit to be lower than a predetermined pressure; a detection unit configured to detect the ink amount in the storage unit, and a determination unit for determining an ink leakage in a case where a change in the ink amount detected by the detection unit is found after the pressurization unit is driven for a predetermined time while the negative pressure generation unit is stopped.

The present invention provides an ink leakage detection method for a printing apparatus, comprising: a printing unit including an ejection port for ejecting ink; a storage unit configured to store ink to be supplied to the ejection port; an ink flow path for connecting the storage unit and the ejection port; a pressurization unit configured to supply pressurized ink from the storage unit to the printing unit; a negative pressure generation unit that is provided at the downstream of the printing unit and that generates a negative pressure in the ink flow path; a differential pressure valve that is provided in the ink flow path and that is opened when the downstream-side pressure of the ink flow path is caused by the negative pressure generation unit to be lower than a predetermined pressure, a first detection step of detecting the ink amount in the storage unit; a driving step of driving, after the first detection step, the pressurization unit for a predetermined time while the negative pressure generation unit being stopped; a second detection step of detecting the ink amount in the storage unit after the driving step; and a determination step of determining an ink leakage in a case where a change is found in the amount of ink detected in the second detection step from the amount of ink detected in the first detection step is found.

According to the present invention, an ink leakage occurred during an ink consumption operation can be detected.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIG. 12 illustrates the ink consumption amount in two types of suction recovery processings;

FIG. 15 illustrates a table to set the upstream-side pressurization time of the negative pressure control unit.

DESCRIPTION OF THE EMBODIMENTS

The following section will describe an embodiment of a liquid ejection apparatus according to the present invention with reference to the drawings in detail. The following description will be made based an ink jet printing apparatus (hereinafter also may be simply referred to as "printing apparatus"). The term "ink" should be widely interpreted as in the above term "printing". Thus, the term "ink" means liquid that may be given onto a printing medium to thereby form an image, a design, a pattern for example, to machine a printing medium, or to process ink (e.g., to solidify or insolubilize the coloring material in ink applied to a printing medium).

First Embodiment

Figure 1:
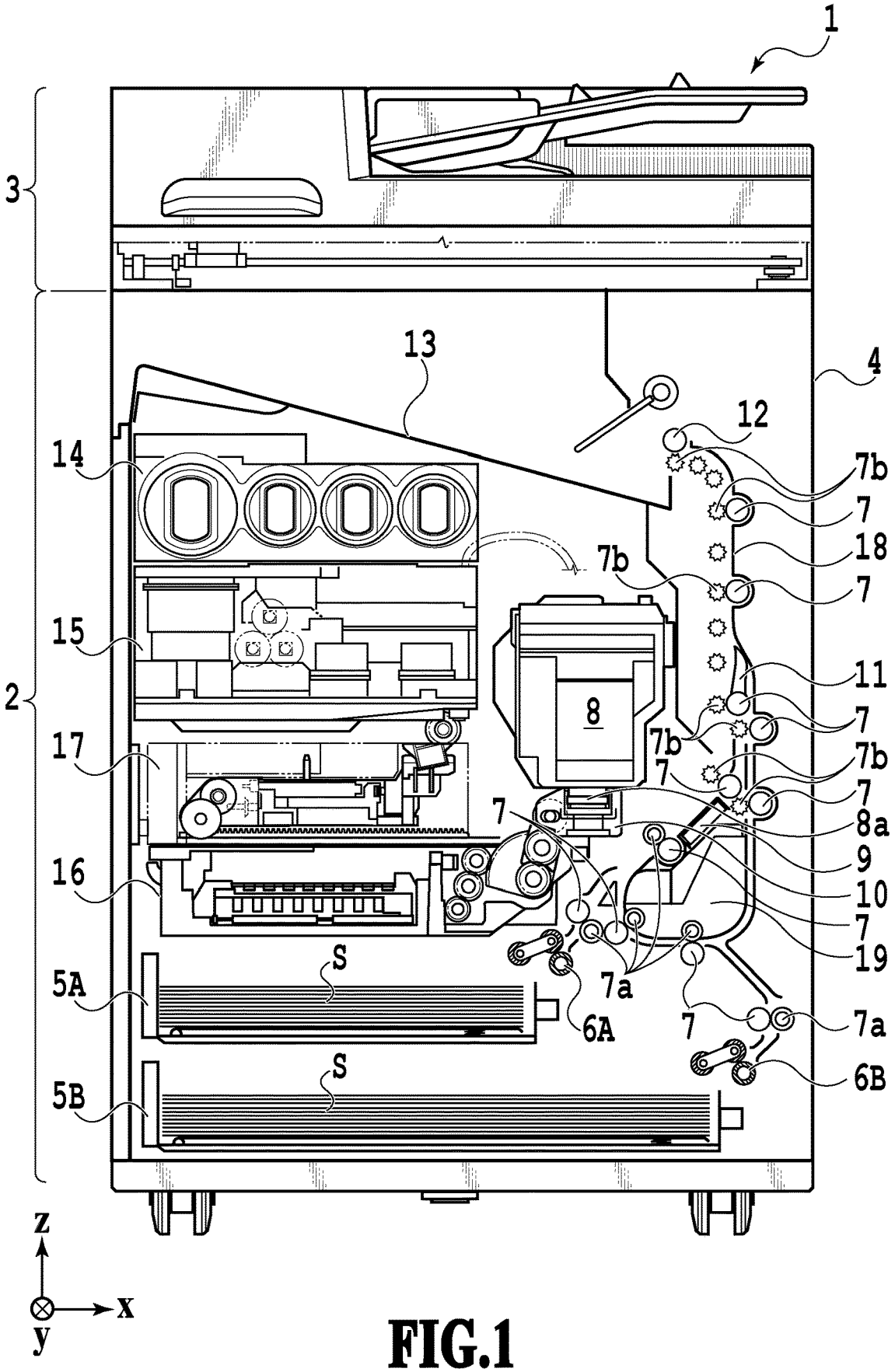
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The printing head 8 of this embodiment is a full line-type color ink jet printing head in which a plurality of ejection ports for ejecting ink are arranged, in accordance with printing data, to correspond to the width of the printing medium S along the y direction in FIG. 1. Specifically. The printing head 8 is configured so that inks of a plurality of colors can be ejected therethrough.

When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
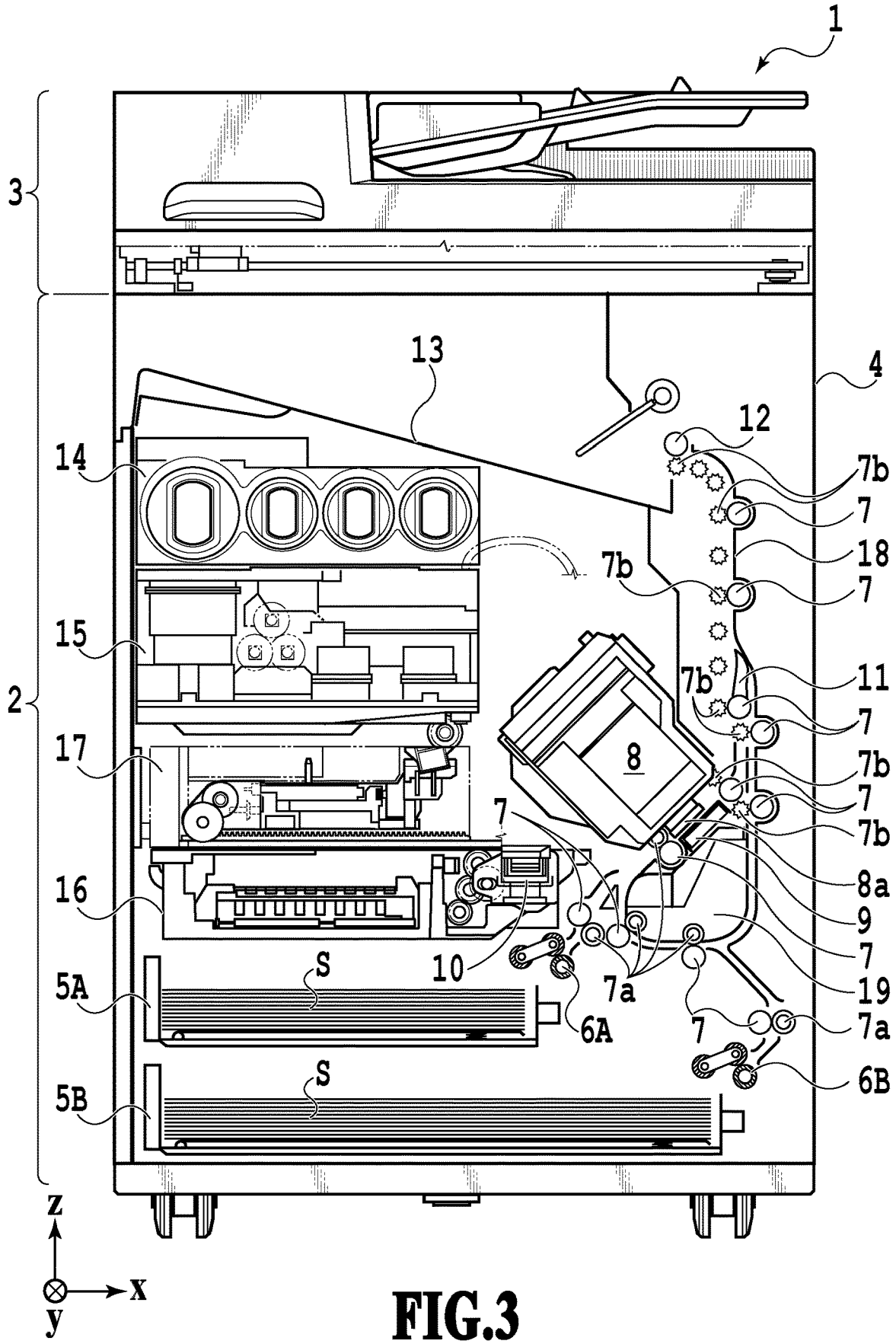
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 4:
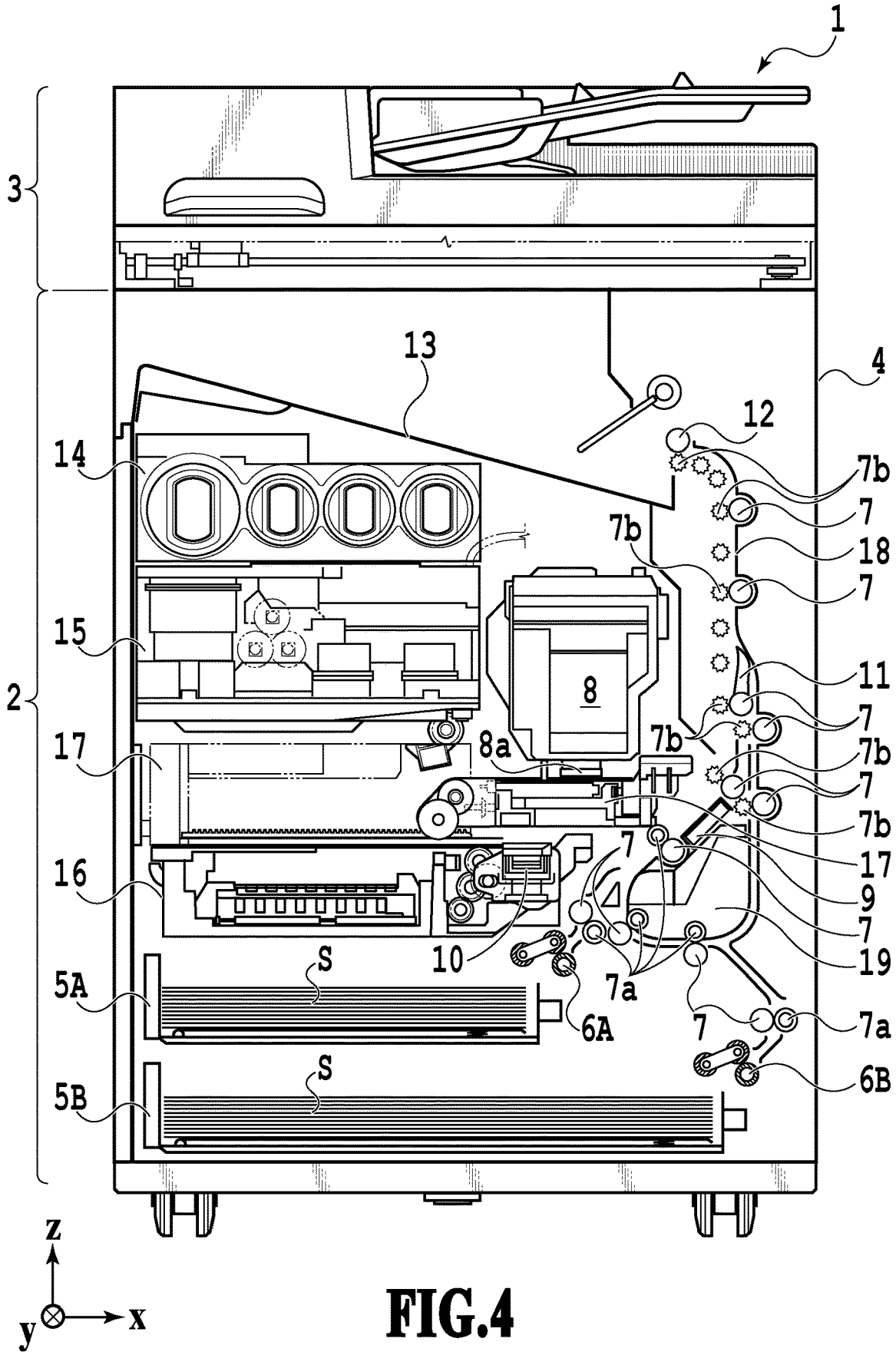
FIG. 4 illustrates the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45°. Following that, the print controller 202 moves the print head 8 vertically downward to the maintenance position where maintenance operation can be performed by the maintenance unit 16.

(Ink Supply Unit)

Figure 5:
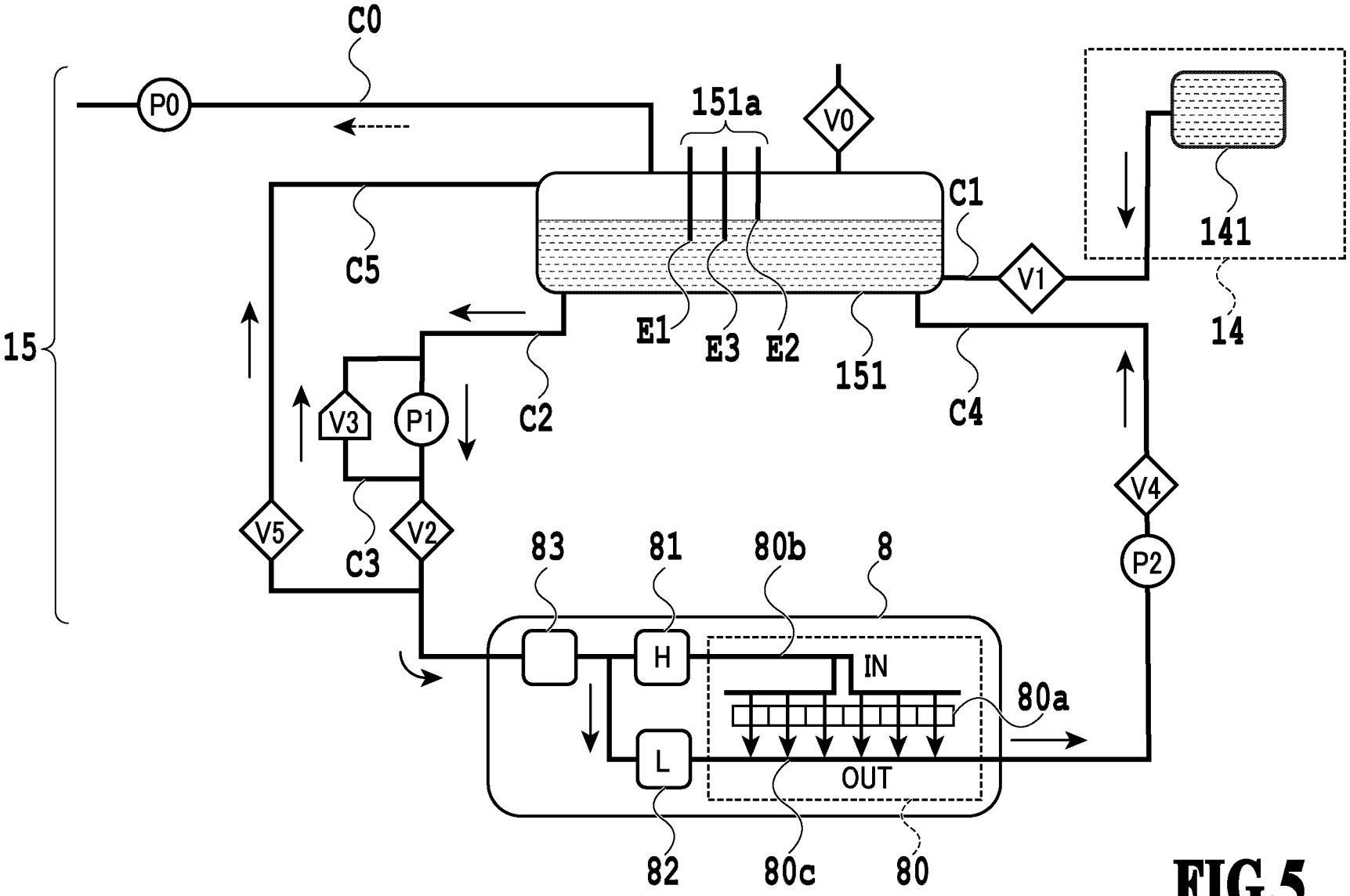
FIG. 5 illustrates the flow path configuration of the ink circulation system.

FIG. 5 illustrates an ink supply unit 15 used in the ink jet printing apparatus 1 of this embodiment. The ink supply unit 15 is configured to supply ink from the ink tank unit 14 to the printing head 8. Although the configuration in which ink of one color is used is shown, a plurality of such configurations are actually used for the respective inks. The ink supply unit 15 are basically controlled by the ink supply control unit 209 shown in FIG. 2. The following the configurations of the respective units.

Ink is mainly circulated between a sub tank 151 and the printing head 8. The printing head 8 performs an ink ejecting operation based on image data. Ink not ejected is collected in the sub tank 151 again.

The sub tank 151 for storing ink of a predetermined amount is connected to a supply flow path C2 to supply ink to the printing head 8 and a collection flow path C4 to collect ink from the printing head 8. Specifically, the sub tank 151, the supply flow path C2, the printing head 8, and the collection flow path C4 constitute a circulation path in which ink is circulated.

The sub tank 151 has a liquid surface detection unit 151*a* having a plurality of pins. In this embodiment, for the purpose of detecting the liquid surface, three electrode pins are provided (the first pin E1 (the first electrode), the second pin E2 (the second electrode), the third pin E3 (the third electrode)) in the sub tank 151 along a vertical direction. The distance between the bottom part of the sub tank 151 and the lower end of the first pin E1 in the vertical direction is shorter than the distance between the bottom part of the sub tank 151 and the lower end of the second pin E2 in the vertical direction. Thus, when ink is supplied into the sub tank 151, then the liquid surface of the ink firstly has a contact with the first pin E1 and then has a contact with the second pin E2 when ink of a predetermined amount is supplied. The distance between the third pin and the sub tank in the vertical direction is set to be equal to or shorter than the distance between the first pin E1 and the bottom part of the sub tank 151 in the vertical direction. Thus, in a state where at least the first pin E1 or the second pin E2 has a contact with the liquid surface, the third pin E3 is allowed to always have a contact with the liquid surface.

A predetermined voltage is applied between the first pin E1 and the third pin E3 and between the second pin E2 and the third pin E3, respectively. The first pin E1 and the second pin E2 touch ink to thereby become conductive with the third pin E3. In this embodiment, the third pin E3 functions as a ground electrode. Thus, this configuration can show, based on whether the respective pins are in a conductive state or a nonconductive state, the height of the ink liquid surface (i.e., the amount of ink remaining in the sub tank 151).

A depressurization pump P0 is a negative pressure generation source to depressurize the interior of the sub tank 151. An atmosphere opening valve V0 is a valve to switch whether or not the interior of the sub tank 151 is allowed to communicate with the atmosphere. The main tank 141 is a tank to store ink supplied to the sub tank 151. The main tank 141 is configured by a flexible member. A volume change of the flexible member is used to allow the sub tank 151 to be filled with ink. The main tank 141 is detachably attached to the body of the printing apparatus. The sub tank 151 is connected to the main tank 141 by a tank connection flow path C1 in the middle of which a tank supply valve V1 is provided opened or closed so as to switch the communication and blocking between the sub tank 151 and the main tank 141.

Under the above-described configuration, when the liquid surface detection unit 151*a* detects that the amount of ink in the sub tank 151 is lower than a predetermined amount, then the ink supply control unit 209 opens the atmosphere opening valve V0, a supply valve V2, a collection valve V4, and a head exchange valve V5 and opens the tank supply valve V1. In this state, the ink supply control unit 209 allows the depressurization pump P0 to operate. Then, the interior of the sub tank 151 is allowed to have a negative pressure, thereby supplying ink from the main tank 141 to the sub tank 151. When the liquid surface detection unit 151*a* allows the ink in the sub tank 151 to reach a predetermined amount, then the ink supply control unit 209 closes the tank supply valve V1 and stops the depressurization pump P0. This operation to supply ink to the sub tank is an operation performed when ink normally flows in the ink supply unit 15. The ink supply is blocked when an ink leakage detection processing (which will be described later) determines that an ink leakage is caused in the ink supply unit 15.

The supply flow path C2 is an ink flow path to supply ink from the sub tank 151 to the printing head 8 in the middle of which a supply pump P1 and the supply valve V2 are provided. During the printing operation, the supply pump P1 can be driven while the supply valve V2 being opened to thereby circulate ink in the circulation path while supplying ink to the printing head 8. The amount of ink consumed by the printing head 8 per a unit time varies depending on image data. The flow rate of the supply pump P1 is determined so as to cope with even a case where the printing head 8 performs an ejecting operation requiring the maximum ink consumption amount per a unit time.

A relief flow path C3 is a flow path provided at the upstream side of the supply valve V2 to connect the upstream side and the downstream side of the supply pump P1 in the middle of which a relief valve V3 is provided that functions as a differential pressure valve. When the amount of ink supplied from the supply pump P1 per a unit time is higher than the total value obtained by adding the ejection amount of the printing head 8 per a unit time to the flow rate of the collection pump P2 per a unit time (ink suction amount), then the relief valve V3 is opened depending on a pressure acting thereon. This consequently forms a circulation flow path configured by a part of the supply flow path C2 and the relief flow path C3. By providing the relief flow path C3 having the above configuration, the amount of ink supplied to printing head 8 can be adjusted depending on the amount of ink consumed in the printing head 8, thus providing a stabilized fluid pressure within the circulation path regardless of image data.

The collection flow path C4 is a flow path to collect ink in the sub tank 151 from the printing head 8 in the middle of which a collection pump P2 and the collection valve V4 are provided. In order to circulate ink in the circulation path, the collection pump P2 functions as a negative pressure generation source to suck ink from the printing head 8. The collection pump P2 can be driven to thereby cause an appropriate pressure difference between an IN flow path 80*b* and an OUT flow path 80*c* of the printing head 8, thereby circulating ink between the IN flow path 80*b* and the OUT flow path 80*c*. The configuration of the flow path in the printing head 8 will be described in detail later.

The collection valve V4 is a valve that prevents an ink backward flow when no printing operation is performed (i.e., when no ink is circulated in the circulation path). The circulation path of this embodiment is configured so that the sub tank 151 is provided at the upper side of the printing head 8 in the vertical direction (see FIG. 1). This causes a risk where, when the supply pump P1 or the collection pump P2 is not driven, a water head difference between the sub tank 151 and the printing head 8 causes an undesirable backward flow of ink from the sub tank 151 to the printing head 8. In order to prevent such a backward flow, this embodiment provides the collection valve V4 in the collection flow path C4.

The supply valve V2 and the head exchange valve V5 also function as a valve to prevent the backward flow from the sub tank 151 to the printing head 8 when no printing operation is performed (i.e., when no ink is circulated in the circulation path).

A head exchange flow path C5 is a flow path that provides the mutual connection between the supply flow path C2 and the air space in the sub tank 151 (a space where no ink is stored) in the middle of which the head exchange valve V5 is provided. One end of the head exchange flow path C5 is connected to the upstream of the printing head 8 of the supply flow path C2 and the other end is connected to the upper part of the sub tank 151 to communicate with the internal air space. The head exchange flow path C5 is used to collect ink from the printing head 8 during use in order to exchange the printing head 8 or to transport the printing apparatus 1 for example. The head exchange valve V5 is controlled by the ink supply control unit 209 so that the head exchange valve V5 is closed except for a case where the printing apparatus 1 is initially filled with ink and a case where ink is collected from the printing head 8. The above-described supply valve V2 is provided between a connection unit of the supply flow path C2 and the head exchange flow path C5 and a connection unit of the relief flow path C3 and the supply flow path C2.

Next, the following section will describe the configuration of the flow path in the printing head 8. Ink supplied from the supply flow path C2 to the printing head 8 is allowed to pass through a filter 83. The resultant ink is subsequently supplied to the first negative pressure control unit 81 that generates a low negative pressure (a negative pressure having a high absolute pressure) and the second negative pressure control unit 82 that generates a high negative pressure (a negative pressure having a low absolute pressure). The pressures in the first negative pressure control unit 81 and the second negative pressure control unit 82 are generated within an appropriate range by the driving of the collection pump P2.

An ink ejection unit 80 has a plurality of printing element substrates 80*a* including therein a plurality of ejection ports to form a long ejection port array. Also provided along the direction along which the printing element substrates 80*a* are arranged are a common supply flow path 80*b* (IN flow path) to guide ink supplied from the first negative pressure control unit 81 and a common collection flow path 80*c* (OUT flow path) to guide ink supplied from the second negative pressure control unit 82. Each of the printing element substrates 80*a* has an individual supply flow path connected to the common supply flow path 80*b* and an individual collection flow path connected to the common collection flow path 80*c*. Thus, ink in each of the printing element substrates 80*a* is allowed to flow into the common supply flow path 80*b* having a relatively-low negative pressure to subsequently flow to the common collection flow path 80*c* having a relatively-high negative pressure. When an ejection operation is performed within the printing element substrates 80*a*, a part of ink moving from the common supply flow path 80*b* to the common collection flow path 80*c* is consumed by being ejected through the ejection port. The not-ejected ink moves to the collection flow path C4 via the common collection flow path 80*c*.

Figure 6A:
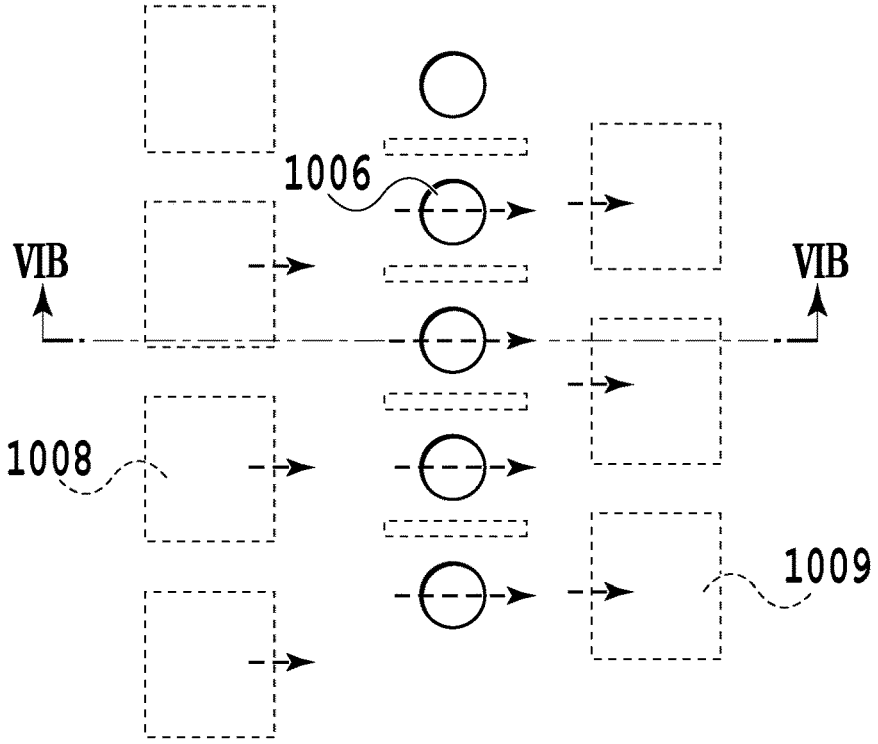
FIGS. 6A and 6B illustrate an ejection port and a pressure chamber.
Figure 6B:
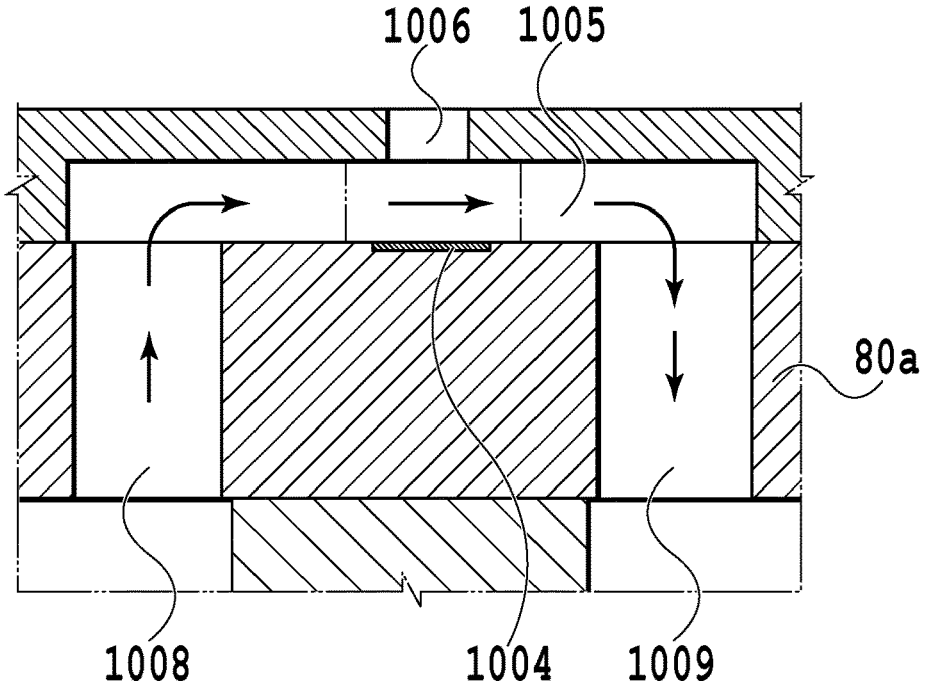

FIG. 6A is an enlarged schematic plan view illustrating a part of the printing element substrate 80*a*. FIG. 6B is a schematic cross-sectional view taken along the section line VIB-VIB in FIG. 6A. The printing element substrate 80*a* includes a pressure chamber 1005 to be filled with ink and an ejection port 1006 for ejecting ink. In the pressure chamber 1005, a position opposed to the ejection port 1006 is provided with a printing element 1004. The printing element substrate 80*a* includes a plurality of individual supply flow paths 1008 connected to the common supply flow path 80*b* and a plurality of individual collection flow paths 1009 connected to the common collection flow path 80*c* to correspond to each ejection port 1006.

The above-described configuration allows the printing element substrate 80*a* to allow ink to flow into the common supply flow path 80*b* having a relatively-low negative pressure (a high pressure) to flow to the common collection flow path 80*c* having a relatively-high negative pressure (a low pressure). More particularly, ink flows in an order of: the common supply flow path 80*b*→the individual supply flow path 1008→the pressure chamber 1005→the individual collection flow path 1009→the common collection flow path 80*c*. When ink is ejected by the printing element 1004, a part of ink moving from the common supply flow path 80*b* to the common collection flow path 80*c* is discharged out of the printing head 8 by being ejected from the ejection port 1006. On the other hand, ink not ejected from the ejection port 1006 is collected in the collection flow path C4 via the common collection flow path 80*c*.

Figure 7A:
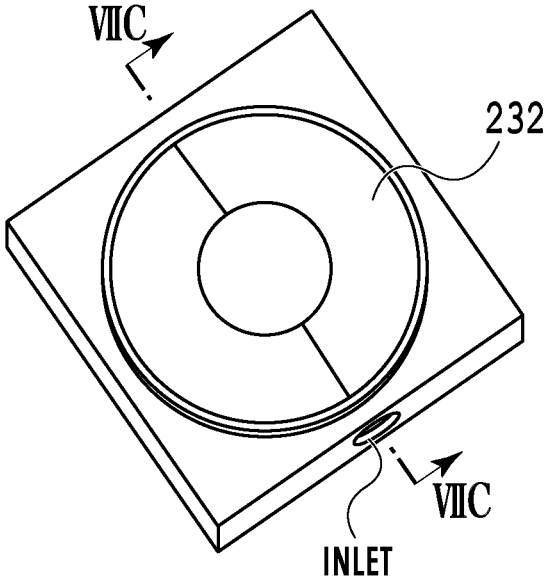
FIGS. 7A to 7C illustrates a negative pressure control unit.
Figure 7B:
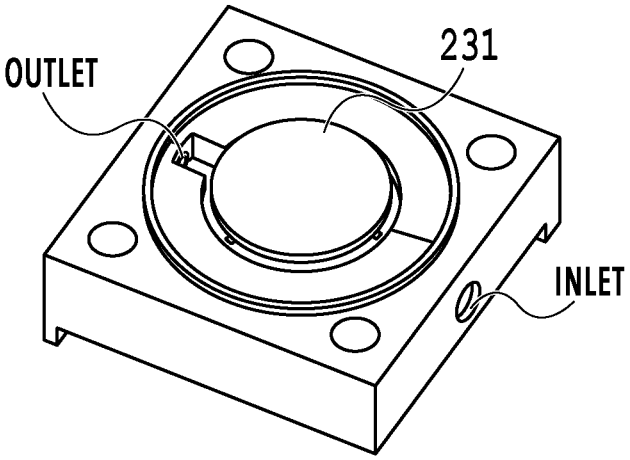
Figure 7C:
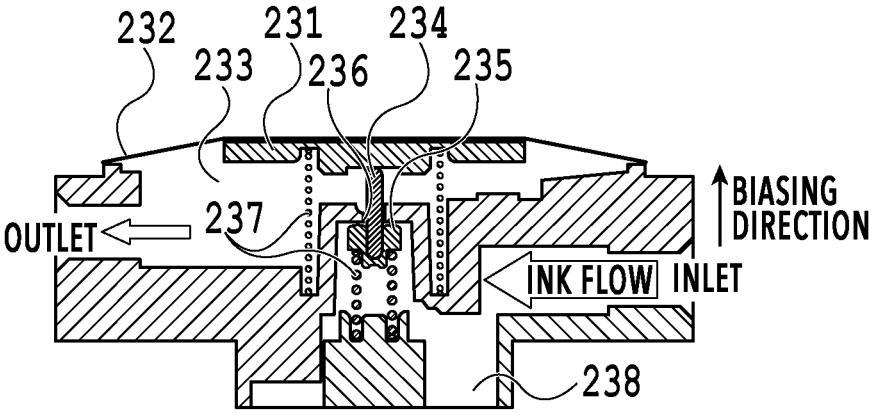

FIGS. 7A to 7C illustrate the first negative pressure control unit 81 provided in the printing head 8. FIGS. 7A and 7B are a perspective view illustrating the appearance. In FIG. 7B, a flexible film 232 is not shown in order to show the interior of the first negative pressure control unit 81. FIG. 7C is a cross-sectional view taken along the line VIIC-VIIC in FIG. 7A. The first negative pressure control unit 81 and the second negative pressure control unit 82 are a differential pressure valve and both have the same configuration except for a difference in the control pressure (spring initial load). Thus, the second negative pressure control unit 82 will not be descried further.

The first negative pressure control unit 81 includes therein the first pressure chamber 233 formed by a pressure plate 231 shown in FIG. 7B and the flexible film 232 for sealing the space at the periphery thereof. The flexible film 232 is welded to a circular edge and the pressure plate 231 shown in FIG. 7B. Depending on an increase or decrease of ink in the first pressure chamber 233, the flexible film 232 and the pressure plate 231 welded to the flexible film 232 are displaced in and out (in the up-and-down direction in FIG. 7B).

The upstream side of the first pressure chamber 233 in the ink supply direction has the second pressure chamber 238 connected to the supply pump P1, a shaft 234 connected to the pressure plate 231, a valve 235 connected to the shaft 234, and an orifice 236 abutted to the valve 235. The orifice 236 of this embodiment is provided at the boundary between the first pressure chamber 233 and the second pressure chamber 238. The valve 235, the shaft 234, and the pressure plate 231 are further outwardly biased (or biased to the upper side in FIG. 7C) by a biasing member (spring) 237.

When the pressure in the first pressure chamber 233 (absolute pressure) is equal to or higher than the first threshold value (or when the first threshold value is higher than the value of a negative pressure), the biasing force from the biasing member 237 causes the valve 235 to be abutted to the orifice 236 to block the communication between the first pressure chamber 233 and the second pressure chamber 238. On the other hand, when the pressure in the first pressure chamber 233 (absolute pressure) is lower than the first threshold value (or when the first pressure chamber 233 receives a negative pressure having a value higher than the first threshold value), the flexible film 232 contracts and is displaced inwardly (or in the downward direction in FIG. 7B). This consequently allows the pressure plate 231 and the valve 235 to be downwardly displaced against the biasing force from the biasing member 237 to move the valve 235 and the orifice 236 away from each other, thus providing the communication between the first pressure chamber 233 and the second pressure chamber 238. This communication allows the ink supplied to the supply pump P1 to flow into the first pressure chamber 233.

The first negative pressure control unit 81 has the above-described differential pressure valve configuration by which an inflow pressure and an outflow pressure are controlled to be constant. In order to allow the second negative pressure control unit 82 to generate a negative pressure higher than that of the first negative pressure control unit 82, the biasing member 237 has a biasing force higher than that of the first negative pressure control unit. Specifically, the second negative pressure control unit 82 opens the valve when a pressure (negative pressure) having a value lower than the second threshold value that is a pressure (absolute pressure) having a value lower than the first threshold value is generated.

Thus, when the collection pump P2 is driven, then the first negative pressure control unit 81 is firstly opened and the second negative pressure control unit 82 is subsequently opened.

Under the above configuration, a printing operation is performed by allowing the ink supply control unit 209 to close the tank supply valve V1 and the head exchange valve V5, to open the atmosphere opening valve V0, the supply valve V2, and the collection valve V4, and to drive the supply pump P1 and the collection pump P2. This consequently establishes the circulation path in an order of the sub tank 151→the supply flow path C2→printing head 8→the collection flow path C4→the sub tank 151. When the amount of ink supplied from the supply pump P1 per a unit time is higher than the total value of the ejection amount of the printing head 8 per a unit time and the flow rate of the collection pump P2 per a unit time, ink is allowed to flow from the supply flow path C2 to the relief flow path C3. This consequently adjusts the flow rate of ink flowing from the supply flow path C2 to the printing head 8.

When no printing operation is performed, the ink supply control unit 209 stops the supply pump P1 and the collection pump P2 and closes the atmosphere opening valve V0, the supply valve V2, and the collection valve V4. This consequently stops the ink flow in the printing head 8 and suppresses the backward flow caused by a water head difference between the sub tank 151 and the printing head 8. By closing the atmosphere opening valve V0, an ink leakage or ink evaporation from the sub tank 151 is suppressed.

The ink is collected from the printing head 8 by allowing the ink supply control unit 209 to close the tank supply valve V1, the supply valve V2, and the collection valve V4, to open the atmosphere opening valve V0 and the head exchange valve V5, and to drive the depressurization pump P0. This allows the sub tank 151 to include therein a negative pressure state to cause the ink in the printing head 8 to be collected in the sub tank 151 via the head exchange flow path C5. As described above, the head exchange valve V5 is a valve that is closed during a normal printing operation and a standby operation and that is opened when ink is collected from the printing head 8. However, the head exchange valve V5 is also opened when the head exchange flow path C5 is filled with ink during the initial filling of the printing head 8.

<Ink Filling>

Next, the following section will describe the ink filling in the ink circulation system described with reference to FIG. 5. The ink filling is performed by attaching, for example, the ink tank unit 14 to the main tank 141 to flow ink in the sub tank 151, the printing head 8, and a flow path in which ink is circulated. The filling operation is performed not only at the arrival of the printing apparatus 1 but also after the ink in the printing head 8 is completely collected in the sub tank 151 in order to exchange or transport the printing head 8.

Figure 8:
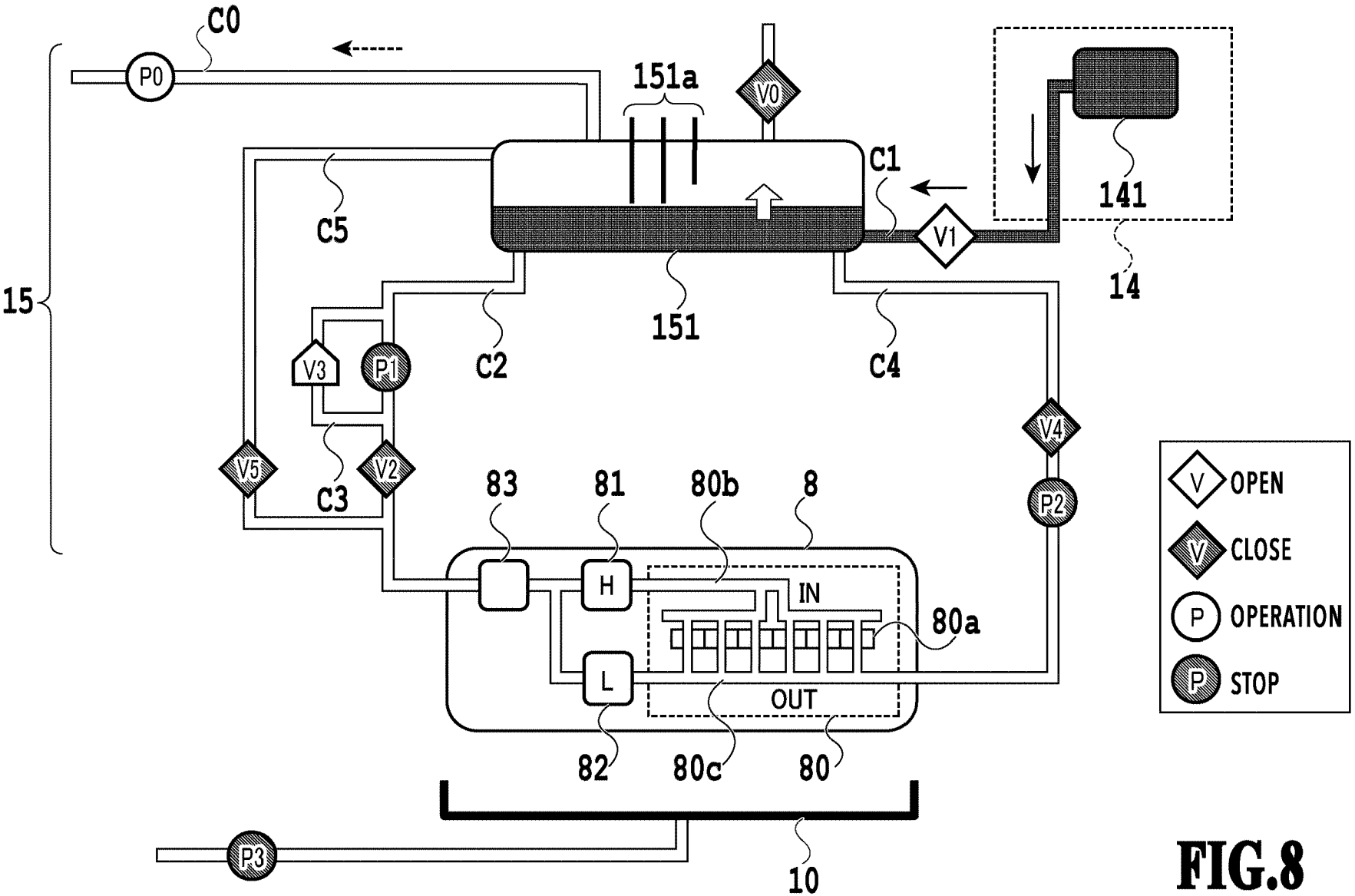
FIG. 8 illustrates the state of the ink circulation system.

FIG. 8 illustrates the state of the ink circulation system to supply ink from the main tank 141 to the sub tank 151. In this state, the atmosphere opening valve V0, the supply valve V2, the head exchange valve V5, and the collection valve V4 are closed (CLOSE) and the tank supply valve V1 is opened (OPEN). The supply pump P1 and the collection pump P2 are stopped. In this state, the depressurization pump P0 is driven to generate a negative pressure in the sub tank 151 to thereby supply ink from the main tank 141 to the sub tank 151 via a tank connection flow path C1. When ink of a predetermined amount is supplied to the sub tank 151, then the ink supply control unit 209 closes the tank supply valve V1 and stops the depressurization pump P0. Thereafter, the ink supply control unit 209 opens the atmosphere opening valve V0 to expose the negative pressure in the sub tank 151 to the atmosphere.

Next, the ink supply control unit 209 supplies ink from the sub tank 151 to fill an upstream flow path with ink. The upstream flow path is a collective term meaning a flow path provided between the sub tank 151 and the printing head 8 and includes the supply flow path C2, the relief flow path C3, and the head exchange flow path C5.

Figure 9:
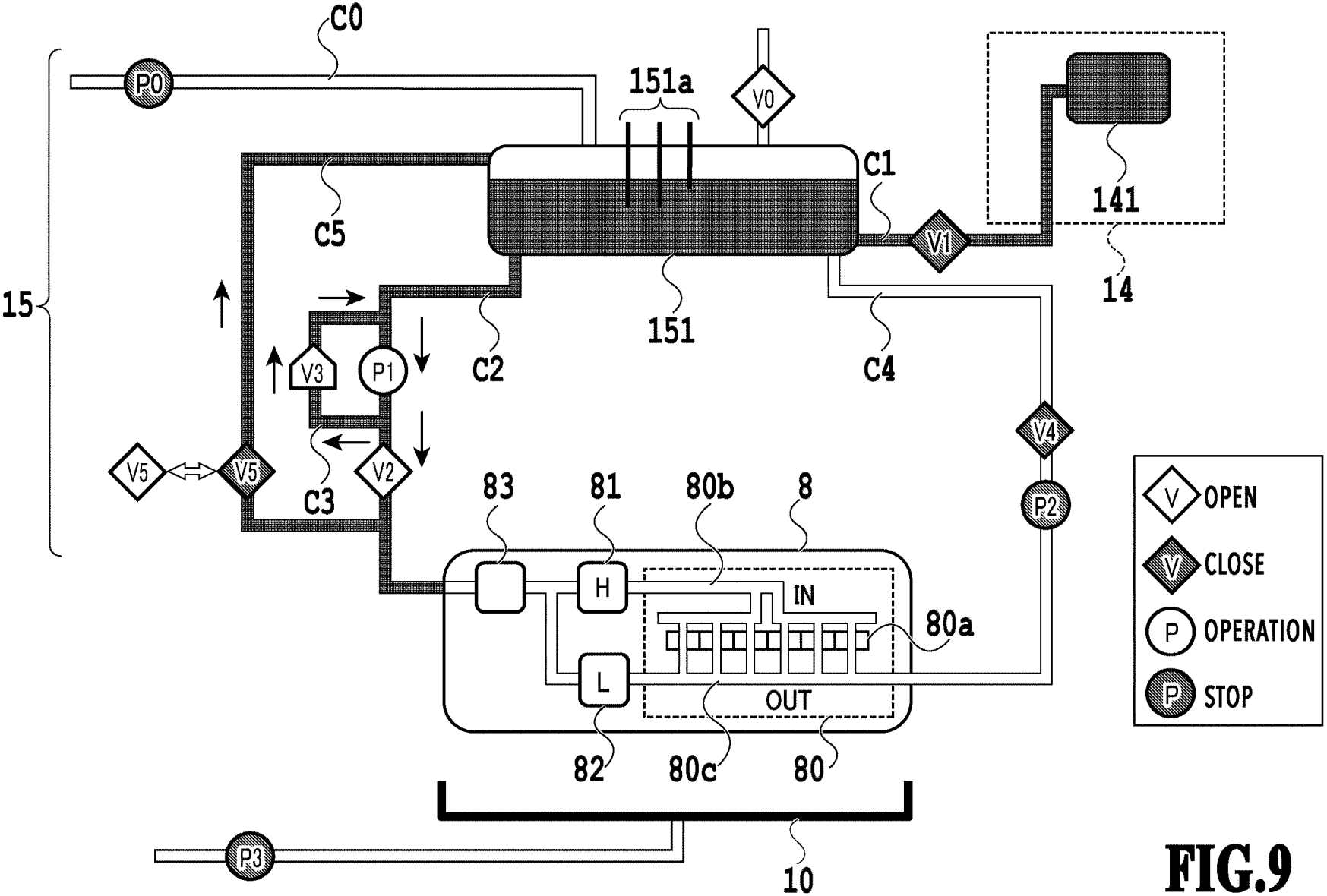
FIG. 9 illustrates the state of the ink circulation system.

FIG. 9 illustrates the state of the ink circulation system when the upstream flow path is filled with ink. The supply valve V2 and the head exchange valve V5 are opened from a state in which the ink supply to the sub tank 151 is completed. When the supply pump P1 is driven from this state, ink is supplied from the sub tank 151 to fill the upstream flow path with ink. The collection pump P2 is stopped and the first negative pressure control unit 81 and the second negative pressure control unit 82 having a differential pressure valve configuration receive no predetermined negative pressure, thus allowing the negative pressure control units 81 and 82 are both closed. Consequently, no ink is supplied to the printing head 8. After the completion of the ink filling in the upstream flow path, the ink supply control unit 209 allows the printing head 8 to be filled with ink.

The above-described ink filling processing in the upstream flow path allows ink to be supplied in the supply flow path C2 in front of the printing head 8. Then, the ink supply control unit 209 drives a cap unit 10 to cap the printing head 8. Specifically, a cap member 10*a* of the cap unit 10 covers the ejection port face 8*a* of the printing head 8. Next, the ink supply control unit 209 drives a depressurization pump P3 of the cap unit 10. Specifically, a negative pressure is generated in the cap unit 10 while sending ink by the supply pump P1. This negative pressure opens the negative pressure control unit in the printing head 8 to suck ink to the ejection port, thereby performing the ink filling operation. After a predetermined time has passed, the ink supply control unit 209 stops the supply pump P1 and the depressurization pump P3. After the completion of the ink filling operation in the printing head 8, the ink supply control unit 209 allows the collection flow path C4 to be filled with ink.

Figure 10:
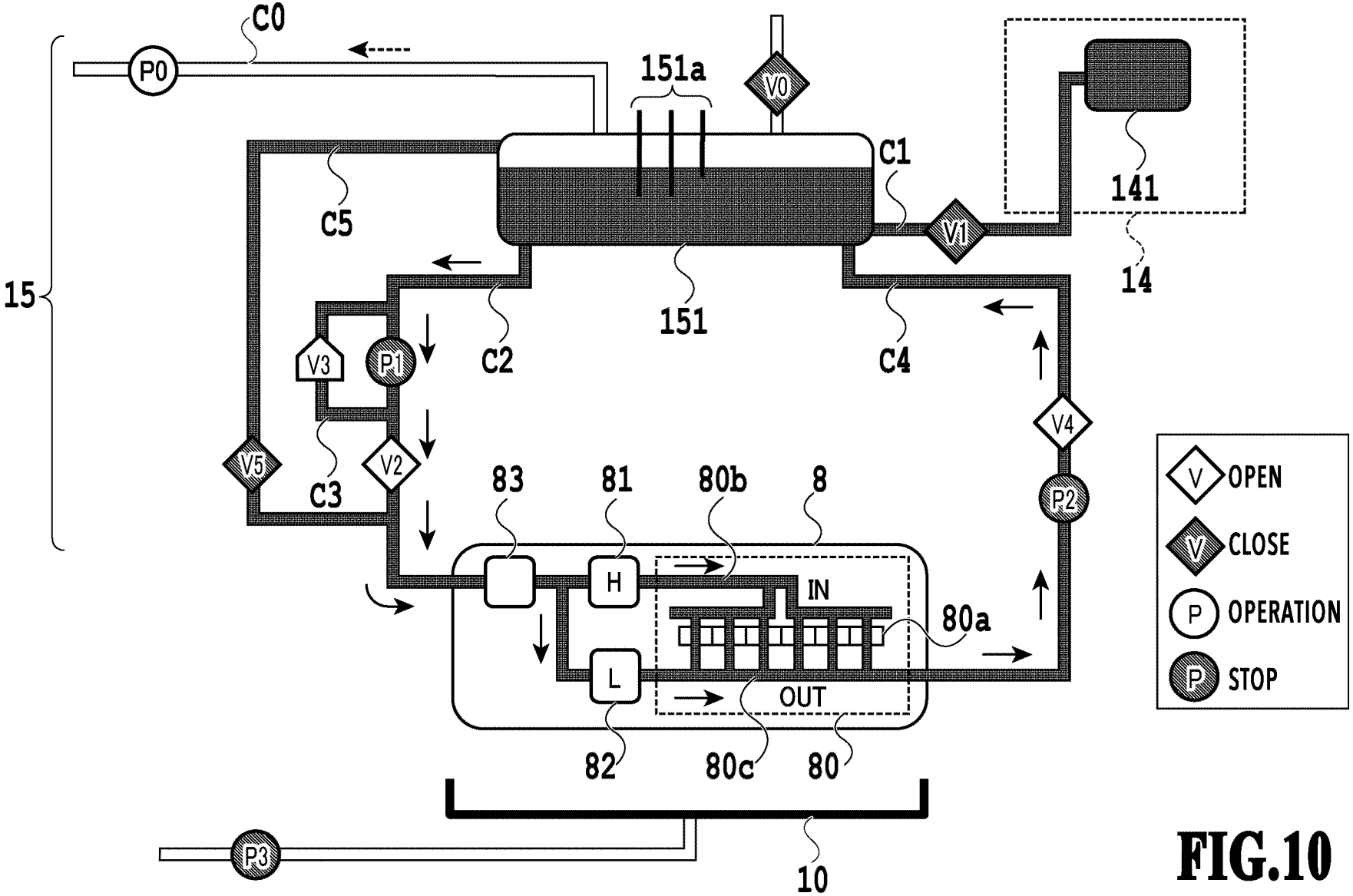
FIG. 10 illustrates the state of the ink circulation system.

FIG. 10 illustrates the state of the ink circulation system when the collection flow path C4 is filled with ink. After the completion of the ink filling operation in the printing head 8, the collection valve V4 is opened and the atmosphere opening valve V0 is closed and the depressurization pump P0 of the sub tank 151 is driven. The ink supply control unit 209 drives the depressurization pump P0 of the sub tank 151 while the collection valve V4 is being opened and the atmosphere opening valve V0 is being closed. The depressurization pump P0 is driven to generate a negative pressure in the sub tank 151 to flow ink from the printing head 8 to the collection flow path C4. After the completion of the ink filling operation in the collection flow path C4, the ink supply control unit 209 stops the depressurization pump P0.

As described above, the sub tank 151, the printing head 8, and the flow path are allowed to be filled with ink to thereby achieve the ink ejection operation by the printing head 8 (i.e., a printing operation). The printing operation is performed by allowing the ink supply control unit 209 to close the tank supply valve V1 and the head exchange valve V5, to close the atmosphere opening valve V0, the supply valve V2, the relief valve V3, and the collection valve V4, and to drive the supply pump P1 and the collection pump P2. This consequently provides an ink circulation to send ink from the sub tank 151 to the printing head 8 to return ink to the sub tank 151 during which ink is ejected from the printing head 8, thereby performing a printing operation on a printing medium.

By performing a printing operation and a recovery operation, ink in the sub tank 151 is consumed to lower the liquid surface of ink in the sub tank 151. The sub tank 151 also has a lower ink liquid surface when an ink leakage occurs in the ink supply unit 15 during a printing operation. Thus, an ink leakage caused during a printing operation cannot be detected by merely detecting a change in the liquid surface in the sub tank 151 by the liquid surface detection unit 151*a*. To solve this, this embodiment uses an ink leakage detection processing described below to detect an ink leakage caused during a printing operation.

<Ink Leakage Detection Processing>

Figure 11:
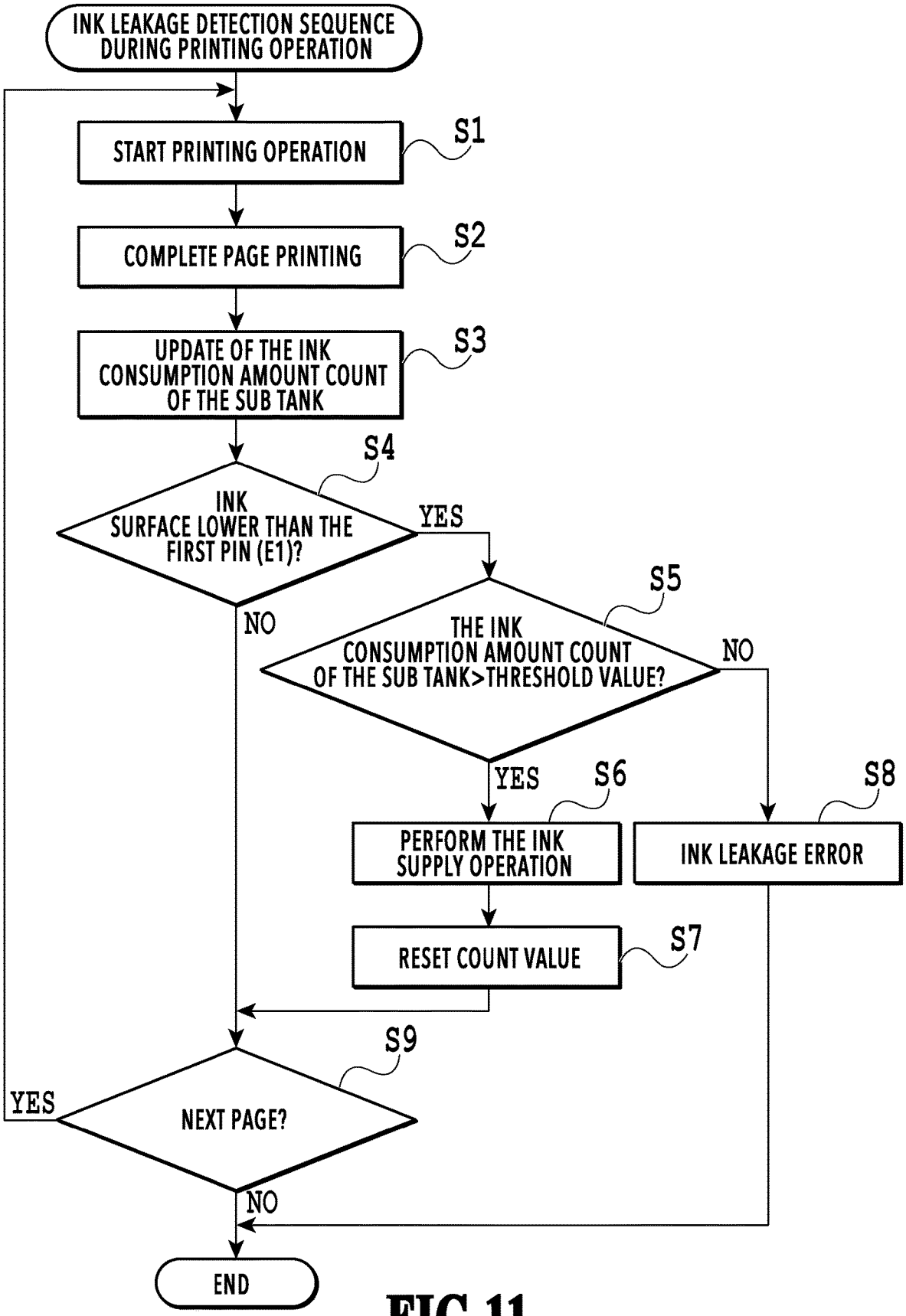
FIG. 11 is a flowchart illustrating an ink leakage detection processing in the first embodiment.

The following section will specifically describe, based on the flowchart shown in FIG. 11, the ink leakage detection processing performed in this embodiment. The processing shown in FIG. 11 is executed by a print controller 202 in accordance with an instruction from a main controller 101 of a controller unit 100. The character "S" followed by each step number means "step".

Prior to the start of a printing operation, a predetermined amount of ink is stored in the sub tank 151 by the ink supply operation. In this embodiment, ink is supplied until ink touches the first pin E1 of the liquid surface detection unit 151*a*. Thereafter, an ink supply operation is performed for a predetermined time. Then, the predetermined amount of ink is stored in the sub tank.

Thereafter, the printing operation is started (S1). The print controller (acquisition unit) 202 starts counting the number at which ink is ejected from the printing head 8. When the printing operation corresponding to one page is completed (S2), then the count value is updated by adding the value counted during the printing operation to the count value stored in a memory (S3).

When a suction recovery processing, or other recovery processing for example is performed during the printing operation, the amount of ink consumed by the recovery processing is converted to the number at which ink droplets are ejected from the printing head 8. The resultant value is added to the count value stored in the memory. This embodiment performs two types of suction recovery processings shown in FIG. 12 (the first suction recovery and the second suction recovery) depending on the status of the use of the printing head 8 for example. The first suction recovery sucks 1 g of ink from the printing head 8 while the second suction recovery sucks 4 g of ink. These recovery processings provides the converted number at which ink droplets are ejected by dividing the amount of ink ejected from the printing head 8 by the ink amount (droplet amount) of ink droplets ejected through the respective ejection ports of the printing head 8.

A value obtained by dividing the amount of ink discharged from the printing head 8 by these recovery processing at the ink amount (droplet amount) of ink droplets ejected through the respective ejection ports of the printing head 8 is the converted value. The converted value is added to the memory as a count value.

As described above, the count value stored in the memory by the print controller 202 represents the ink amount consumed by the ink consumption operation such as the printing operation and the recovery processing (i.e., the decrease amount of ink stored in the sub tank 151). Thus, the print controller 202 functions as a detection unit to detect a decrease amount showing a difference between the amount of ink stored in the sub tank 151 prior to an ink consumption operation (e.g., prior to a printing operation) and the amount of ink stored in the sub tank 151 after the ink consumption operation (e.g., after the printing operation).

When the printing operation corresponding to one page is completed and the count value in the memory is updated, then the print controller 202 determines whether or not the ink liquid surface in the sub tank 151 is lower than the lower end of the first pin E1 of the liquid surface detection unit 151*a* (S4). This determination is performed by detecting whether or not the first pin E1 and the third pin E3 are conductive. When the ink in the sub tank 151 has a position lower than the lower end of the first pin E1 and has no contact with the first pin E1, then the processing proceeds to S5. When the ink liquid surface has a position higher than or equal to the lower end of the first pin E1 and the ink touches the first pin E1, the processing proceeds to S9.

In S5, it is determined whether or not the count value corresponding to the amount of ink consumed by the printing operation and the recovery operation for example (the count value stored in the memory (acquisition amount)) exceeds a threshold value. This threshold value functions as a reference for the determination in S5 and is set based on a count value corresponding to a decrease amount (ink consumption amount) caused when the liquid surface of a predetermined amount of ink supplied to the sub tank 151 prior to a printing operation drops down to the lower end of the first pin E1. Specifically, the threshold value also may be the same value as the count value corresponding to the decrease amount. Alternatively, the threshold value also may be set to a value lower than the count value corresponding to the decrease amount in consideration of a count error for example. In this embodiment, the decrease amount is 16 g and the threshold value is set to a count value (predetermined value) corresponding to 10 g in consideration of a count error for example.

When the determination result in S5 shows that the count value caused by the ink consumption operation is equal to or less than the threshold value, then it means that the amount of consumed ink exceeds the amount of ink consumed by the printing operation and the recovery operation. In this case, an ink leakage in the ink supply unit 15 may be expected. Thus, when it is determined that the count value caused by the ink consumption operation is equal to or lower than the threshold value (10 g), an ink leakage error is notified in S8.

When the determination result in S5 shows that the count value caused by the ink consumption operation exceeds the threshold value on the other hand, it means that ink is not appropriately consumed. Thus, in order to prepare for the next printing operation, ink is supplied from the main tank 141 to the sub tank 151 (S6). This ink supply operation stores a predetermined amount of ink in the sub tank 151. After the completion of the ink supply operation, then the count value stored in the memory is reset (S7).

As described above, this embodiment counts the ink consumption amount caused by the printing operation and the recovery operation as a number at which ink droplets are ejected and monitors the position of the ink liquid surface in the sub tank 151. When the count value showing the number at which ink droplets are ejected is lower than the decrease amount of ink in the sub tank 151, then it is determined that ink is excessively consumed by an ink leakage, thereby notifying an ink leakage error. Thus, a user can recognize, even during the printing operation, the occurrence of the ink leakage in the ink supply unit 15 in an early stage. This can consequently suppress the wasteful consumption of ink, thus realizing a reduced running cost. This also can minimize the damage in the apparatus due to leaked ink.

In the above embodiment, a predetermined amount of ink is supplied into the sub tank 151 by setting an ink supply time for supplying ink from the main tank 141 to the sub tank 151 after the ink is detected by the first pin E1. However, a method of supplying a predetermined amount of ink to the sub tank 151 is not limited to this. For example, a control can be performed by which ink is supplied until the ink liquid surface touches the second pin E2 of the liquid surface detection unit 151*a* provided in the sub tank 151 to thereby supply the predetermined amount of ink to the sub tank 151.

Second Embodiment

Next, the following section will describe the second embodiment of the present invention. This embodiment similarly includes the configurations shown in FIG. 1 to FIG. 7C.

The ink supply from the main tank 141 to the sub tank 151 is performed by driving the depressurization pump P0 while an atmosphere exposure valve V0 is being closed and the tank supply valve V1 is being opened. In this ink supply operation, the liquid surface in the sub tank 151 touches the second pin E2 of the liquid surface detection unit 151*a* and then a predetermined amount of ink is supplied. This consequently stores the predetermined amount of ink in the sub tank 151.

During a printing operation, the supply pump P1 is in a driving state and the upstream side of the first negative pressure control unit 81 and the second negative pressure control unit 82 provided in the printing head 8 are pressurized. When the collection pump P1 is driven to increase the downstream-side negative pressure of the respective negative pressure control units 81 and 82, then the first and second negative pressure control units 81 and 82 are opened. This allows the ink pressurized by the supply pump P1 to be supplied to the ejection port (pressurized supply). When the collection pump P1 is stopped, then the respective first and second negative pressure control units 81 and 82 have a decreased negative pressure at the downstream side, thereby closing the negative pressure control units 81 and 82. Then, when the respective first and second negative pressure control units 81 and 82 function normally, the negative pressure control units 81 and 82 are not opened even when the upstream side is pressurized by the driving of the supply pump P1.

However, in the case where dust for example enters the respective first and second negative pressure control units 81 and 82 to prevent the negative pressure control units 81 and 82 from being appropriately opened, the pressurization of the upstream side causes ink to flow to the downstream side of the negative pressure control units. In this case, a risk is caused where the pressurization of the ink in the ejection port of the printing head 8 may cause ink to be leaked from the ejection port.

To solve this, this embodiment performs an ink leakage detection processing to detect whether or not an ink leakage occurs during the printing operation including a failure of the negative pressure control units 81 and 82 as described above. This ink leakage detection processing is performed by pressurizing the upstream side of the negative pressure control units 81 and 82 to detect a state change of the ink liquid surface in the sub tank 151 (or a drop of the liquid surface). Specifically, the upstream side of the negative pressure control units 81 and 82 is pressurized for a predetermined time to thereby determine any change in the ink liquid surface in the sub tank 151 as the drop of the ink liquid surface due to an ink leakage, thereby notifying an ink leakage error.

Figure 13:
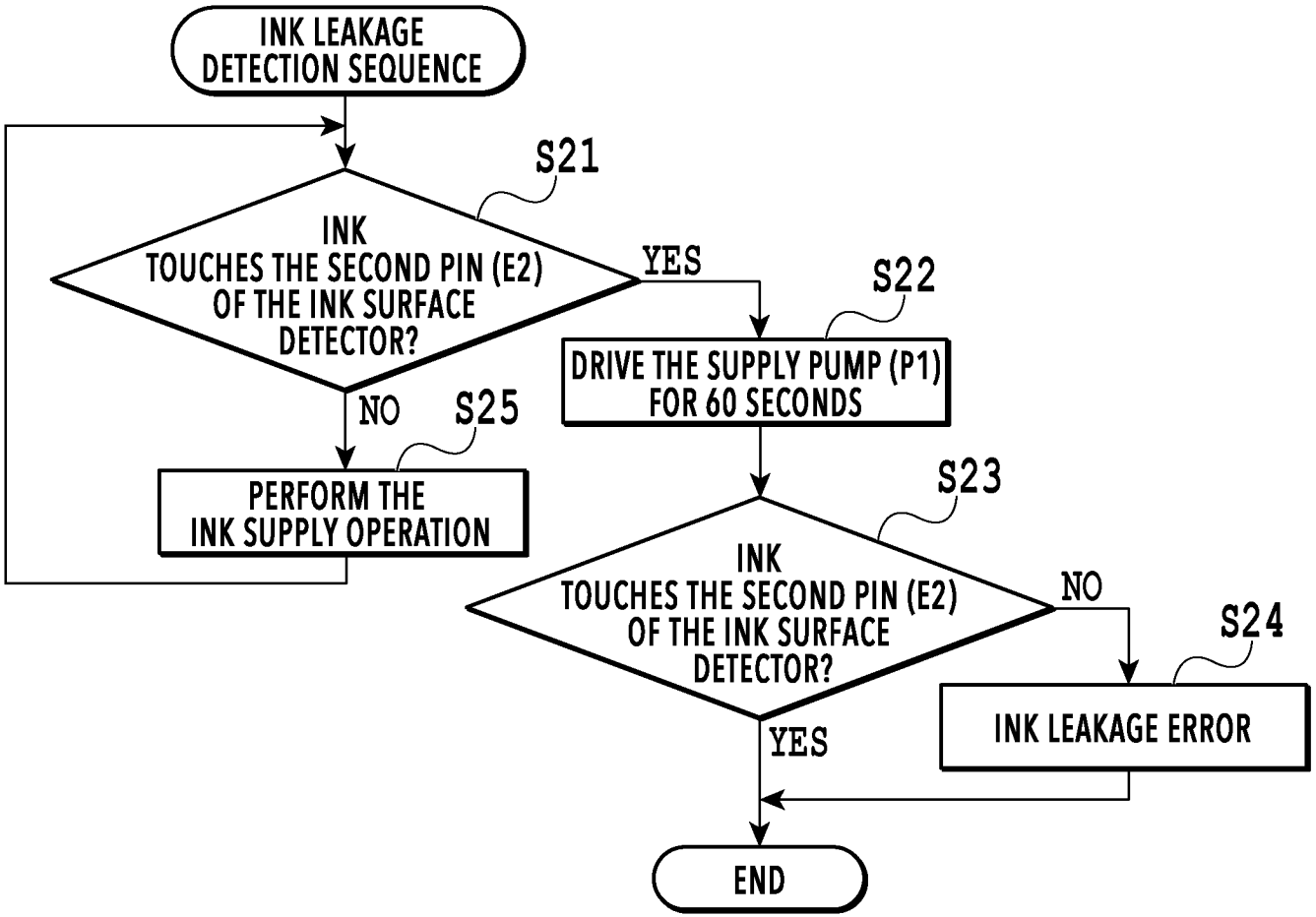
FIG. 13 is a flowchart illustrating the ink leakage detection processing in the second embodiment.

The following section will describe the ink leakage detection processing performed in this embodiment based on the flowchart of FIG. 13. The communication between the sub tank 151 and the main tank 141 is also blocked by the tank supply valve V1 in this embodiment except when ink is supplied to the sub tank.

In S21, it is determined whether or not ink touches the second pin E2. This determination is performed by detecting whether or not the second pin E2 and the third pin E3 are in a conductive state via ink. When ink does not touch the second pin E2, an ink supply operation is performed in S25 to allow ink to touch the second pin E2. In this embodiment, the contact between the second pin E2 and ink is detected to subsequently supply another fixed amount of ink to raise the ink liquid surface in the sub tank 151 to a fixed position higher than that of the second pin.

When the determination in S21 determines that ink touches the second pin E2, then the supply pump P1 is driven for a predetermined time to pressurize the upstream side of the negative pressure control units 81 and 82 (S22). In this embodiment, the supply pump P1 is driven for 60 seconds.

Thereafter, it is determined whether or not the ink in the sub tank 151 touches the second pin E2 (S23). When it is determined that the ink in the sub tank 151 does not touch the second pin E2, it can be estimated that pressurized ink is allowed to pass through the negative pressure control units 81 and 82 to flow to the downstream side. Thus, in this case, it is determined that the negative pressure control units 81 and 82 function abnormally (or have a failure), thereby notifying an ink leakage error (S24).

When it is determined in S23 that the ink in the sub tank 151 continuously touches the second pin E2, then it is determined that no change is caused in the ink liquid surface, thereby completing the ink leakage detection processing. The above ink leakage detection processing is performed for a predetermined period during which no printing operation is performed.

As described above, this embodiment makes it possible to estimate whether or not an ink leakage occurs during a printing operation due to the negative pressure control units 81 and 82 having a defective operation. This can consequently reduce the harmful influence due to an ink leakage during a printing operation (e.g., an increased running cost due to an increased ink consumption amount). This can also consequently minimize the damage in the apparatus due to leaked ink.

Third Embodiment

The ink leakage detection in the above embodiment was based on an assumption that a predetermined amount of ink is supplied to the interior of the sub tank 151 and the upstream side of the negative pressure control units 81 and 82 is pressurized by the supply pump P1 for a fixed period (60 seconds). However, the amount of ink supplied to the interior of the sub tank 151 decreases due to a printing operation. Thus, there is another possibility where the amount of ink stored in the sub tank is already decreased when the ink leakage detection is performed. In such a case, a time at which the upstream side of the negative pressure control units 81 and 82 is pressurized is desirably changed. Specifically, when the pressurization time is reduced while a high amount of ink is being stored in the sub tank 151, a possibility is caused where a change in the ink liquid surface cannot be detected by the liquid surface detection unit 151*a* in spite of an ink leakage from the negative pressure control units 81 and 82. When the pressurization time is increased while the ink amount is small on the other hand, the liquid surface detection unit 151*a* can require a longer time to detect an ink leakage but, thus failing to provide an efficient processing. Furthermore, ink in a higher-than-required amount is undesirably pumped to the downstream side of the negative pressure control units, causing another possibility where a high amount of ink is leaked from an ejection port for example.

In order to prevent this, the ink leakage detection in this embodiment is performed by detecting the amount of ink supplied in the sub tank 151 to pressurize, depending on the detected ink amount, the upstream side of the negative pressure control units 81 and 82.

Figure 14:
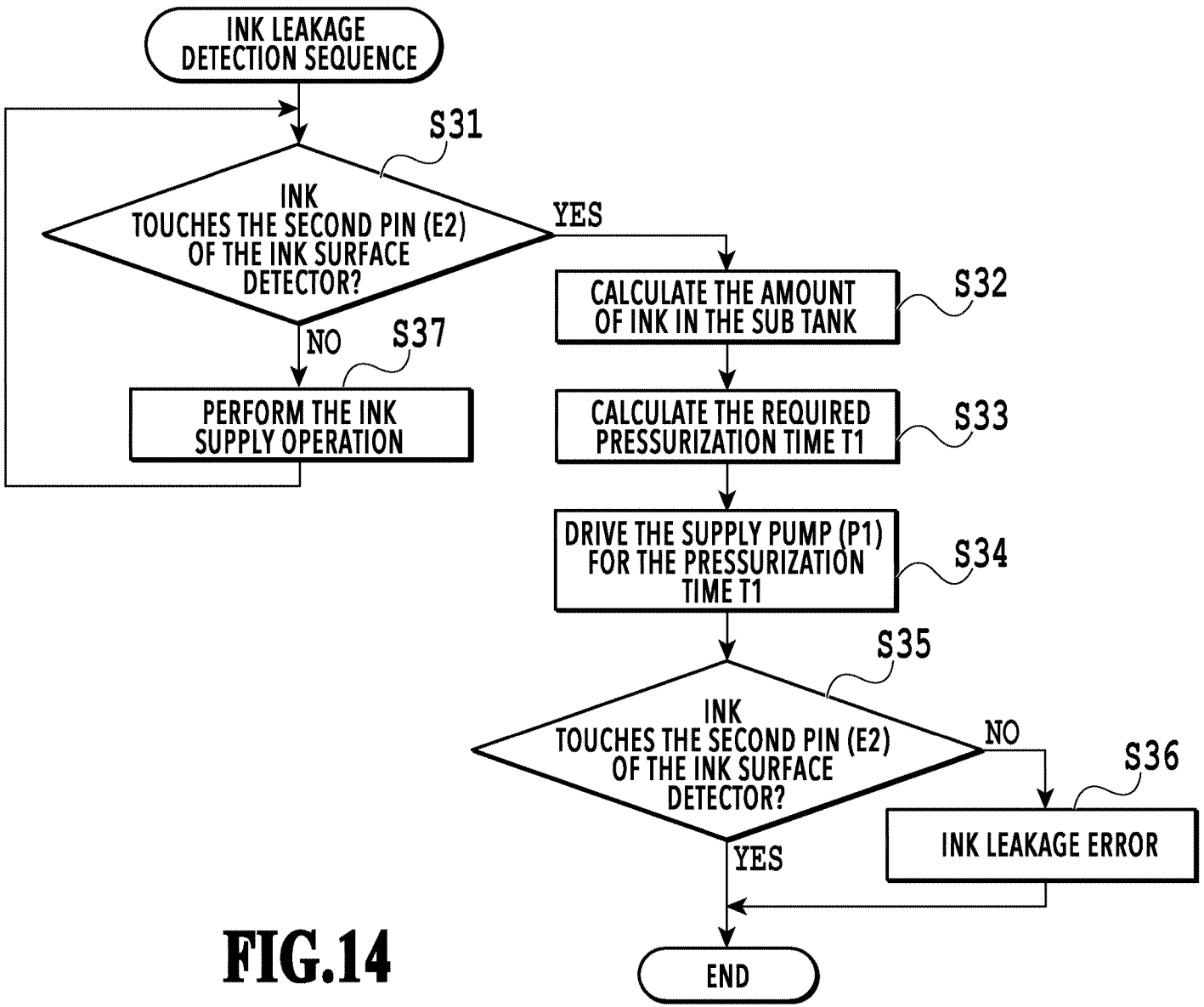
FIG. 14 is a flowchart illustrating the ink leakage detection processing in the third embodiment.

FIG. 14 is a flowchart illustrating the ink leakage detection processing performed in this embodiment.

In S31, it is determined whether or not the ink supplied in the sub tank 151 touches the second pin E2 of the liquid surface detection unit 151*a*. When the ink touches the second pin E2, the processing proceeds to S32. When the ink does not touch the second pin E2, an ink supply operation is performed in S37.

In S32, the amount of ink stored in the sub tank 151 is calculated. This amount can be estimated based on the time during which the ink supply operation is continued after the liquid surface reaches the second pin E2 of the liquid surface detection unit 151*a* (the driving time of the depressurization pump P0) and the amount of ink consumed by the printing operation after the ink supply.

According to this embodiment, the second pin E2 of the liquid surface detection unit 151*a* has a lower end set to the same height as the liquid surface when 80 g of ink is supplied to the sub tank 151. The ink supply operation is continued for 4 seconds after ink touches the second pin E2. In this embodiment, 2 g of ink is supplied by a one-second ink supply operation. Thus, the ink amount in the sub tank 151 (initial ink amount) just after the completion of the ink supply operation is 88 g.

After the ink supply, when ink is consumed by the printing operation or the recovery operation, the amount of ink in the sub tank 151 gradually decreases. This ink consumption amount can be counted as an ink ejection operation number to thereby calculate the amount of ink consumed by the printing operation or the recovery operation. The calculated ink amount can be deducted from the initial ink amount to thereby calculate the current amount of ink stored in the sub tank.

Thereafter, in S33, based on the current amount of ink stored in the sub tank calculated as described above, the pressurization time T1 for the upstream side of the negative pressure control units 81 and 82 is set for the ink leakage detection. This pressurization time T1 can be found by referring to a table as shown in FIG. 15 for example. When the table shown in FIG. 15 is used and when the amount of ink supplied in the sub tank 151 is 84 g or more, then the pressurization time T1 is set to 60 seconds. When the amount of ink supplied in the sub tank 151 is 80 g or more and lower than 84 g, the pressurization time T1 is set to 50 seconds.

Next, in S34, the supply pump P1 is driven for the pressurization time T1 set in S33. Thereafter, in S35, whether or not ink touches the second pin E2 is determined. When it is determined that ink does not touch the second pin E2, it can be determined that pressurized ink passes through the negative pressure control units 81 and 82 to flow to the downstream side. Thus, in this case, it is determined that the negative pressure control units 81 and 82 function abnormally (or have a failure), thereby notifying an ink leakage error (S36).

When ink in the sub tank 151 touches the second pin E2 in S35, it is determined that no change is found in the ink liquid surface and the negative pressure control units 81 and 82 function normally, thus completing the ink leakage detection processing.

As described above, according to this embodiment, it is possible to detect an ink leakage during a printing operation caused by a defective operation of the negative pressure control units 81 and 82 having a valve function. Furthermore, this embodiment adjusts, depending on the amount of ink supplied in the sub tank (storage unit), the pressurization time T1 for the upstream side of the negative pressure control units 81 and 82, thus detecting an ink leakage in a secure and efficient manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189671 filed Oct. 5, 2018, which is hereby incorporated by reference wherein in its entirety.

What is claimed is:

1. A printing apparatus, comprising:

a storage unit configured to store ink;

a printing unit configured to eject ink supplied from the storage unit to perform a printing operation on a printing medium;

a detection unit configured to detect a liquid surface of the ink stored in the storage unit;

an acquisition unit configured to acquire a consumption amount of ink consumed in the printing operation from the storage unit;

a calculation unit configured to calculate a decrease amount that is a difference between the ink amount in the storage unit detected by the detection unit prior to the printing operation and the ink amount in the storage unit detected by the detection unit after the printing operation; and a determination unit configured to determine an ink leakage in a case where a difference between the decrease amount calculated by the calculation unit and the consumption amount acquired by the acquisition unit is larger than a threshold value.

2. The printing apparatus according to claim 1, wherein: the detection unit includes an electrode provided in the storage unit at a predetermined height and the electrode has a conductive state when touching the ink.

3. The printing apparatus according to claim 2, further comprising: an ink supply unit configured to supply a predetermined amount of ink to the storage unit in a state that the electrode therein touches the ink, and the determination unit configured to determine an ink leakage when the printing operation is started while the predetermined amount of ink is stored in the storage unit and the detection unit detects that the electrode does not touch the ink and an amount acquired by the acquisition unit is lower than a predetermined value based on the predetermined amount.

4. The printing apparatus according to claim 3, wherein: the detection unit includes a first electrode and a second electrode provided in the storage unit, a lower end of the second electrode positioned at an upper side of a lower end of the first electrode in a vertical direction, and the ink supply unit supplies the predetermined amount of ink by supplying ink to the storage unit until the second electrode touches the ink.

5. The printing apparatus according to claim 1, wherein: the printing apparatus includes a notification unit configured to notify an error in a case where an ink leakage is determined by the determination unit.

6. A printing apparatus, comprising:

a printing unit including an ejection port for ejecting ink;

a storage unit configured to store ink supplied to the ejection port;

an ink flow path for connecting the storage unit and the ejection port;

a pressurization unit for supplying pressurized ink from the storage unit to the printing unit;

a negative pressure generation unit that is provided at the downstream of the printing unit and that generates a negative pressure in the ink flow path;

a differential pressure valve that is provided in the ink flow path and that is opened when the downstream-side pressure of the ink flow path is caused by the negative pressure generation unit to be lower than a predetermined pressure;

a detection unit configured to detect the ink amount in the storage unit, and a determination unit for determining an ink leakage in a case where a change in the ink amount detected by the detection unit is found after the pressurization unit is driven for a predetermined time while the negative pressure generation unit is stopped.

7. The printing apparatus according to claim 6, wherein the pressurization unit changes the pressurized supply time depending on the amount of ink detected by the detection unit.

8. The printing apparatus according to claim 6, wherein: the detection unit detects a liquid surface of the ink stored in the storage unit.

9. The printing apparatus according to claim 6, wherein: the detection unit includes an electrode provided in the storage unit at a predetermined height and the electrode has a conductive state when touching the ink.

10. The printing apparatus according to claim 9, further comprising: an ink supply unit configured to supply a predetermined amount of ink to the storage unit in a state that the electrode therein touches the ink, the determination unit determines an ink leakage when the detection unit detects that no ink touches the electrode.

11. The printing apparatus according to claim 6, wherein: the printing apparatus includes a notification unit configured to notify an error in a case where an ink leakage is determined by the determination unit.

12. The printing apparatus according to claim 6, wherein: the ink flow path includes a supply flow path to supply ink to the printing unit and a collection flow path to collect ink from the printing unit and the negative pressure generation unit includes a collection pump provided in the collection flow path.

13. The printing apparatus according to claim 12, wherein: the differential pressure valve includes a first differential pressure valve opened at a first negative pressure and a second differential pressure valve opened at a second negative pressure stronger than the first negative pressure.

14. The printing apparatus according to claim 13, wherein: the printing unit further has a pressure chamber that includes a printing element and that is connected to the ejection port and the collection pump is driven to open the first differential pressure valve and the second differential pressure valve to circulate ink through a circulation path including the storage unit, the supply flow path, the interior of the pressure chamber, and the collection flow path.

15. An ink leakage detection method for a printing apparatus, comprising:

a printing unit including an ejection port for ejecting ink;

a storage unit configured to store ink to be supplied to the ejection port;

an ink flow path for connecting the storage unit and the ejection port;

a pressurization unit configured to supply pressurized ink from the storage unit to the printing unit;

a negative pressure generation unit that is provided at the downstream of the printing unit and that generates a negative pressure in the ink flow path;

a differential pressure valve that is provided in the ink flow path and that is opened when the downstream-side pressure of the ink flow path is caused by the negative pressure generation unit to be lower than a predetermined pressure, a first detection step of detecting the ink amount in the storage unit;

a driving step of driving, after the first detection step, the pressurization unit for a predetermined time while the negative pressure generation unit being stopped;

a second detection step of detecting the ink amount in the storage unit after the driving step; and a determination step of determining an ink leakage in a case where a change is found in the amount of ink detected in the second detection step from the amount of ink detected in the first detection step is found.

* * * * *